United States Patent [19]
Keith et al.
[11] 4,140,561
[45] Feb. 20, 1979

[54] EXPLOSIVE COMPOSITION AND PROCESS WITH RHEOLOGY MODIFYING AGENT

[75] Inventors: Donald G. Keith, Mount Eliza; Robin S. Murray, Ivanhoe, both of Australia

[73] Assignee: ICI Australia Limited, Victoria, Australia

[21] Appl. No.: 915,193

[22] Filed: Jun. 13, 1978

[30] Foreign Application Priority Data

Jun. 24, 1977 [AU] Australia ..... PD0549

[51] Int. Cl.[2] ..... C06B 45/00

[52] U.S. Cl. ..... 149/2; 149/21; 149/41; 149/42; 149/43; 149/44; 149/60; 149/61; 149/76; 149/83; 149/85; 149/110; 149/115

[58] Field of Search ..... 149/2, 41, 21, 110, 149/42–44, 60, 61, 76, 83, 85, 115

[56] References Cited

U.S. PATENT DOCUMENTS 3,507,718 4/1970 Mortensen et al. ..... 149/44 X

*Primary Examiner*—Stephen J. Lechert, Jr.
*Attorney, Agent, or Firm*—Cushman, Darby & Cushman

[57] ABSTRACT

A slurry explosive composition which contains fibrous material as a rheology modifying agent.

15 Claims, No Drawings

EXPLOSIVE COMPOSITION AND PROCESS WITH RHEOLOGY MODIFYING AGENT

This invention relates to explosive compositions of matter and more particularly it relates to slurry explosive compositions of matter.

Slurry explosives comprise inorganic oxidizing salt, fuel, a liquid solvent, disperser or carrier for said salt and, optionally, at least one thickening agent. Although the term "slurry" is applied to such compositions the degree of consistency may range from pourable or pumpable fluids of varying viscosity, through viscous extrudable gels up to friable materials such as are described in Australian Patent Specification No. 483 568 and which may be packaged in the form of cartridges. The oxidizing salt component usually comprises nitrate, chlorate or perchlorate of ammonia, sodium, potassium, calcium or barium, the most extensively used salt being ammonium nitrate. The liquid phase may vary widely in its chemical constitution, consistency, and explosive sensitivity. Thus, in water-bearing slurries, the liquid phase may consist mainly of an aqueous solution of inorganic oxidizing salt, but nonaqueous slurry compositions are known wherein the liquid phase comprises a liquid chemical compound which acts as a fuel to contribute energy to the composition. So as to increase the viscosity of slurry explosives of the kind described thickening agents for example gums such as guar gum or xanthan gums, or synthetic polymers such as polyacrylamide or copolymers thereof have been used in an attempt to prevent segregation of the ingredients or to prevent deterioration in wet conditions. It has also been proposed that improved homogeneity and storage properties could be obtained by crosslinking the thickening agents with crosslinking agents, for example potassium pyroantimonate, sodium dichromate, potassium dichromate or rare earth salts, or a redox system for example a mixture of an arsenious compound and sodium dichromate. Whilst such attempts to modify the physical form and storage properties of slurry explosives have been reasonably successful, it has been observed that the rheology of these explosive compositions is somewhat dependent on temperature. Thus for example when such compositions are stored or used in semitropical or tropical areas it has been observed that the compositions became less coherent and that certain of the components, such as metallic fuels, tended to segregate on storage.

It has now been discovered that the addition of small amounts of fibrous material to slurry explosive compositions of the type described improves the storage characteristics of these compositions and modifies the rheological and physical properties of the composition.

Accordingly there is provided a slurry explosive composition which comprises at least one inorganic oxidizing salt, a liquid solvent disperser or carrier for said salt, fuel material, optionally at least one thickening agent which optionally may be crosslinked, and as a rheology modifying agent an amount of fibrous material.

The fibrous material used in the invention should not be confused with the comminuted or powdered irregularly shaped materials such as for example wood meal, sawdust, metallic powders or flakes which have been used as fuel or sensitizing additives in prior art explosive compositions. Our present fibrous material is distinct from such prior art materials in that our fibrous materials are characterized in that they are derived from materials in which the longitudinal/transverse dimensional ratio ranges from about 10:1 to 1000:1 or more. By fibrous material we mean material which is formed of fibres, the said fibres being thread-like bodies or filaments that at least in part comprise, or can be derived from, animal or vegetable tissue, resinous materials, polymeric materials or minerals. Natural fibre lengths vary from about 2 millimeters for cellulose pulp fibres and asbestos fibres, up to 125 millimeters for wool, and as much as 1000 millimeters for flax while many synthetic polymeric materials are available in continuous filaments. Typical textile fibre diameters range from 0.01 to 0.04 microns for asbestos fibrils which are the basis for the bunches or spicules of asbestos which are commonly used to make asbestos-bearing products, whilst diameters of synthetic fibres lie in range from 3 to 500 microns. A diversity of fibrous materials is suitable for use in the invention. Thus we have found that naturally occurring and synthetic or man-made materials are useful, and within this wide class that inorganic or organic materials are suitable. Examples of suitable materials include glass fibres, glass rovings, anhydrite whiskers, ductile metal fibres, refractory oxide fibres such as are available under the registered trade mark of "Saffil" and in the form of alumina or zirconia; asbestos; carbon fibres; man-made fibres derived from cellulose such as rayon, cellulose acetate or cellulose triacetate; fibres derived from synthetic resins such as urea-formaldehyde, melamine-formaldehyde, or phenol-formaldehyde; polymeric fibres used in the manufacture of textiles such as fibres of the acrylic type like those fabricated from polyacrylonitrile, polyamides such as nylon 6 or nylon 66, polyesters such as polyethylene terephthalate or polytetramethylene terephthalate, polyolefines such as polyethylene, polypropylene or polytetrafluoroethylene, polyurethane fibres such as those commonly referred to as spandex fibres, or fibres such as those from the formal derivatives of polyvinyl alcohol. Vegetable fibres are also useful and such materials are available in a range from fine threads to coarse fibres. Typically useful vegetable fibres include hard vegetable fibres such as leaf fibers like sisal, or soft vegetable fibres of the bast type such as hemp or jute, or seed fibres like kapok. Cotton fibres are also useful and fibres derived from animals such as wool or cowhair may also be used. If desired, mixtures of fibres may be used as a rheology modifying agent. In instances where the fibrous material is derived from a polymer such a polymer may be a homopolymer or a copolymer such as a block or graft copolymer and may optionally be substituted or modified. It is convenient to use the fibres in comparatively short lengths and many chopped fibres are available commercially in lengths up to about 30 millimeters. Thus for example glass fibres used in the invention are conveniently in the form of chopped rovings or strands having a length in a range from about 3 to 12 millimeters. Such fibres often have a surface treatment comprising a film forming material which reduces abrasion or fracture of the glass. Some fibres like jute which has a fibre length in a range from 1 to 5 millimeters or kapok which has a fibre length in a range from 15 to 30 millimeters may not need to be converted to shorter lengths prior to use, but other vegetable fibres such as sisal, which is often in lengths from 600 to 1600 millimeters, or hemp ribbons which may be up to 5000 millimeters long will usually need to be shortened prior to use to lengths of 30 millimeters or less, typically in a range from 0.5 to 20 millimeters and often in a range from 5 to 15 millimeters. Polymeric, resinous or man-made fibres may be converted to any desired length prior to use and such lengths are similar to those referred to above. The fibrous materials may have a circular or quasicircular cross section and dependent on their origin or mode of manufacture may be in the form of solid rods or tubes. The diameter of such materials will vary, in the instances of vegetable or animal fibres; thus jute fibres have a diameter in a range from about 14 to 20 microns whilst wool fibres have a diameter in a range from 18 to 40 microns and sisal fibres range from about 125 to 500 microns in diameter. The diameter of suitable synthetic fibres is more controllable than is the diameter of the naturally occurring fibres and the use of synthetic fibres is preferred. A wide range of synthetic fibres is available commercially from fine hosiery fibres to cords used for car tyre manufacture. Typical suitable fibres are those having a diameter in a range from 5 to 100 microns, say in a range from 10 to 40 microns. The fibrous materials may also be treated so as to be in a bulked form and synthetic fibres derived from rayon, polyacrylonitrile, polyamides or polyesters are especially suitable for conversion to such a form. The fibrous materials, especially those derived from synthetic polymers, may also contain components derived from differing polymeric materials to provide heterogeneous or conjugate fibres. They may also be fabricated so as to provide fibres in which the cross-section is other than circular; thus the cross-section of a suitable fibre may be for example tri-lobal. The amount of fibrous material used in the compositions of the invention will depend to some extent on the nature of the fibre, on the nature of the composition to be modified and the extent to which it is desired to modify the rheology of the composition. We have found that the incorporation of up to about 3% w/w, say from 0.001 to 2% w/w, of the composition of fibrous material is adequate for most purposes and usually the amount of fibrous material used constitutes from 0.1 to 0.6% w/w of the composition.

In general, except for the rheology modifying agent, the compositions of our invention are of conventional types. Thus the oxygen releasing salts used as ingredients in our compositions may be, for example, inorganic nitrates, chlorates and perchlorates and mixtures thereof. We prefer that the oxygen releasing salt material be chosen from the perchlorates or nitrates of the alkali and alkaline earth metals or ammonium and of these we prefer sodium nitrate, calcium nitrate, ammonium perchlorate and ammonium nitrate. The amount of oxygen releasing salt in such compositions is not narrowly critical; we have found that compositions containing amounts of oxygen releasing salts from 30% w/w to 90% w/w of the total composition are satisfactory and amounts from 60% w/w to 85% w/w are preferred. The particle size and shape of the oxygen releasing salt is not critical and is well known from the art of ammonium nitrate manufacture; powders and prilled particles are satisfactory.

The liquid solvent, disperser or carrier for the oxygen releasing salt will, in the more generally used compositions, be water but useful non-aqueous compositions can be prepared wherein the liquid comprises non-aqueous liquids, for example diethylene glycol, ethanolamine, formamide, dimethylformamide, dimethylsulphoxide, or liquid salt mixtures comprising, for example, ammonium acetate or ammonium formate. When water is used as the liquid the proportion thereof in the compositions should be sufficient to dissolve at least part of the oxygen releasing inorganic salt and at least part of any water soluble fuel which may be present, and also be sufficient to hydrate at least part, preferably all, of any gummy gelling agent present. Suitably the amount of water when present may constitute from 3% w/w to 35% w/w of the total composition, but the amount present should not be in excess of the explosive limit of the composition. We prefer that the water be in the range from 3% w/w to 25% w/w of the total composition. In the instance where the explosive composition is of the pourable or pumpable type it is more preferred that water constitute from 12% w/w to 17% w/w of the composition; where the composition is of a friable type a very suitable range for the water content is from 3% w/w to 14% w/w and a range from 4% w/w to 10% w/w is especially preferred. When the said liquid is essentially a non-aqueous liquid it suitably constitutes from 5 to 30% w/w of the composition. A preferred class of non-aqueous liquids useful as components of the compositions of the invention is the class of liquid amines as disclosed in the prior art explosive compositions described in the specification of U.S. Pat. No. 4,055,450. Such liquid amines include alkylene diamines, alkanolamines and alkylamines and may be typified by reference to amines such as ethylene diamine, ethanolamine, ethylamine, diethylamine or butylamine. In the instance where the said liquid is in the form of a melt derived from a mixture of salts it is convenient that the said liquid constitutes from about 20 to about 60% w/w of the composition. Typically the liquid is derived from a mixture of oxygen-releasing salt material such as ammonium nitrate, sodium nitrate or calcium nitrate, and melt soluble fuel material such as carboxylates, thiocyanates, amines or amides which may be typified by reference to substances such as ammonium acetate, ammonium formate, ammonium thiocyanate, hexamethylene tetramine, dicyandiamide, thiourea, acetamide or urea. It is convenient that the fuel material component of the said mixture of salts constitutes from about 30 to about 70% w/w of the said mixture of salts. Such mixtures of salts are known and are described for example in the specification of our copending Australian patent application No. 30130/77.

When referring to fuels or fuel materials in this specification we mean substances which are stable in such explosive compositions, that is prior to detonation, during preparation and storage the substance is chemically inert to the system. The said substances must be combustible and their physical nature should be such that they may be incorporated in our compositions in a manner so as to be uniformly distributed throughout the compositions. Such fuels are well known in the art and they may be organic or inorganic and may also be derived from animals and plants.

The fuels when employed in the compositions of this invention can be, for example, non-explosive carbonaceous, non-metallic and metallic fuels or mixtures of the aforementioned types of fuels. They can be varied widely.

Suitable fuels include organic water soluble substances for example urea, carbohydrates such as sugars or molasses, water soluble alcohols or glycols, glues or mixtures of these. Suitably the proportion of water soluble fuel in our compositions is in the range from 0.5% w/w to 10% w/w, preferably from 4 to 7% w/w, of the total composition.

Other suitable fuels include water insoluble or sparingly water soluble materials which may be chosen from inorganic materials for example sulphur, aluminium, silicon, ferrosilicon, ferrophosphorus, magnesium, titanium, boron, mixtures thereof for example mixtures of aluminium with ferrosilicon, or organic materials for example finely divided charcoal, anthracite, gilsonite, asphalt, cellulosic materials such as sawdust, or cereal products for example flours, dextrins or starches. When the inorganic fuel is a metal it is preferably in granulated or powdered form. Such granulated or powdered metal may be in the form of discrete particles, but metal powders wherein the metal is in the form of flakes or in the form of aggregates of particles or flakes are also satisfactory. Preferred fuels are the metallic powders. The most preferred metallic fuel is aluminium. The proportion of water insoluble or sparingly water soluble non-metallic fuels in such compositions may suitably be in the range from 1% w/w to 10% w/w of the total composition and amounts from 4% w/w to 7% w/w of the total composition are preferred. The proportion of metallic water insoluble fuels when present in such compositions may be as high as 25% w/w and amounts in the range from 0.5% w/w to 20% w/w of the total compositions are preferred.

Where desirable, it is convenient to add to the explosive compositions according to our invention, in amounts expressed as parts by weight per 100 parts by weight of the final mixture, other conventional additives used in slurry explosives. Such additives may include for example anti-foaming agents, for example ethyl hexanol, in amounts ranging e.g. from 0 to 0.1 part, or surfactants, for example non-ionic surfactants such as alkylene oxide condensates of phenols, acids or amides, from 0 to 5 parts. When desired, additional sensitisers in the form of gas or a mixture of gases such as air may be added to our compositions. Thus it may be added in the form of injected or stirred in air or gas or it may be added as air or gas encapsulated in or attached to the surface of particulate material. Alternatively a gas, such as nitrogen or carbon dioxide, may if desired be generated in the composition by known means, Where desirable there may be included as a component of our compositions one or more conventional thickening agents, for example gums such as the galactomannan or xanthan gums. Typical examples of galactomannan gums are guar gum or derivatives thereof and locust bean gum whilst the xanthan gums may be typified by reference to biopolymeric materials which are produced by processes comprising the transformation of carbohydrate material by means of micro-organisms such as those of the species of Xanthomonas. A very useful biopolymeric material is that available under the trade name of "Biopolymer" XB23 which is derived from a polymer which has been reacted with *Xanthomonas campestris.* Preferably such gums, when used in our compositions are in a crosslinked form. When such gums are used in our compositions it is convenient to use amounts such that the gum component comprises from 0.1 to 3% w/w, more usually from 0.3 to 1.5% w/w, of the composition.

In general the explosive compositions of our invention may be prepared by the conventional formulating techniques used for preparing slurry explosives. Thus for example a part or all of the oxygen releasing salt may be in the form of a solution of the salt or part may be incorporated in powdered or prilled form. Fuel materials when used may also be incorporated in a dry form or alternatively in the form of a dispersion or solution in part of the liquid component. It has been found convenient to add the rheology modifying agent to the composition by adding the agent itself to the stirred composition either at a constant rate of addition or in quanta or aliquots such that the agent is dispersed through the composition. Alternatively a dispersion of the modifying agent in a part of the liquid component may be added to and mixed with the composition.

When guar gum is used as a component of the compositions of the invention it is preferred that there be present in the composition a sufficiency of liquid to ensure that the gum component is at least partially solvated. When agents are used to crosslink such gum it is preferred that such an agent be added as one of the final ingredients. In instances where such a crosslinking agent is a system comprising two or more components it is desirable that whilst some of the components may be incorporated at any stage of the preparation of the mixture, the last ingredient added is a component of the crosslinking system. Thus for example when such a crosslinking system is a redox system it is desirable that the oxidizer component of that system be added to the composition as the final ingredient. Other thickening agents such as synthetic polymers and copolymers may also be used; for example polymers derived from acrylamide, and especially copolymers derived from acrylamide and containing mer units which bear bidentate groups are satisfactory. Typical examples of such copolymers are those derived from a major proportion of acrylamide and a minor proportion of 2-acetoxyethyl methacrylate or methacryloylacetone optionally with mer units derived from acrylonitrile.

The invention also includes a method of preparing a slurry explosive composition, which method comprises mixing inorganic oxidizing salt and fuel material with a liquid solvent disperser or carrier for said salt, optionally mixing therewith at least one thickening agent which optionally may be crosslinked, to form a mixture and modifying the rheology characteristics of said mixture by incorporating therein an amount of fibrous material.

The compositions of the invention are advantageous over similar non-modified compositions of the prior art in that the rheology of the compositions of the invention is such that it provides enhanced resistance to physical change which may be induced by change in temperature of the composition. The compositions of the invention are more robust and coherent than are their unmodified counterparts of the prior art. Furthermore the individual components of the composition do not tend to segregate as much as is observed in unmodified similar prior art compositions.

The invention is now illustrated by, but is not limited to, the following examples wherein all parts and percentages are expressed on a weight basis unless otherwise specified. Examples 1, 11, 36 and 42 do not lie within the invention and are included for the purposes of comparison.

EXAMPLE 1

In this comparative example a water bearing explosive composition was prepared and transferred to waxed paper containers to provide explosive cartridges. To an aqueous solution containing 192 parts of water and 8 parts of a copolymer derived from acrylamide and hydroxyethyl methacrylate in a molar percentage ratio of 95:5 there was added 16 parts of thiourea, 877 parts of powdered ammonium nitrate, 249 parts of sodium nitrate and 116 parts of urea. The mixture was heated at a temperature of 40° C with stirring to form a premix. To the premix so formed there was admixed 270 parts of prilled ammonium nitrate, 140 parts of atomized aluminium powder the bulk of which was capable of passing through a 200 mesh British Standard sieve and which was available commercially under the designation of "Aluminium Powder 125" from Alcoa of Australia Limited, and 60 parts of pregelled starch. When the resultant mixture was homogeneous 8 parts of a solution containing equal weights of water and sodium dichromate were added and mixing was continued for 5 minutes. 18 parts of a solution containing equal weights of water and sodium nitrite were then added followed by the admixture with stirring of 60 parts of paint fine aluminium which was in the form of a powder the bulk of which was capable of passing through a 325 mesh U.S. Bureau of Standards sieve and which was available commercially from Alcoa of Australia Limited under the designation of "Aluminium powder No 408". The resultant composition was pumped into waxed paper containers to form explosive cartridges. The cartridges were detonable at a temperature of 10° C using one No 8 aluminium detonator and had a velocity of detonation of 2.8 kilometers per second.

EXAMPLES 2 to 5 INCLUSIVE

The general procedure of Example 1 was repeated except that in the present examples there was added, immediately prior to the incorporation of the sodium dichromate solution into the composition, an amount of a fibrous component as set out below. In each example it was observed that the resultant compositions were different in regard to their rheological properties in comparison with the composition of Example 1. Shortly after the fibrous material had been incorporated into the composition it was observed, in general qualitative terms, that the compositions were more viscous and ultimately assumed a coherent putty-like consistency. The compositions obtained were detonable.

TABLE 1

| | Fibrous Additive | | |
|---|---|---|---|
| Example | Type | Amount (parts) | Fibre length (millimeters) |
| 2 | Nylon 66* | 3 | 2 to 6 |
| 3 | Polyester** | 3 | 2 to 6 |
| 4 | Nylon | 3 | 10 to 20 |
| 5 | Glass | 20 | 6 |

*The nylon fibres had a trilobal cross section and were drawn and bulked from fibres having an equivalent diameter of 40 microns. They contained 0.69% titanium oxide and had been derived from nylon 66 polymer.
**The polyester fibres were derived from polyethylene terephthalate and had a diameter of 13 microns and contained 1.5% titanium oxide.

EXAMPLE 6

To 1490 parts of ethanolamine there was added 6177 parts of powdered ammonium nitrate and 1990 parts of powdered sodium nitrate and the mixture was heated with stirring to a temperature of 80° C. There was then added 50 parts of a surfactant which was a condensate of stearic acid with ethylene oxide and contained 9 moles of ethylene oxide per 1 mole of stearic acid, followed by 80 parts of hydroxypropyl guar gum. The mixture was stirred until a weak gel began to form whereupon the stirred mixture was cooled and 195 parts of nitrocellulose which was dampened with 30% of its weight with water was incorporated into the stirred mixture, followed by 40 parts of bulked polyacrylonitrile fibres which were from 15 to 25 millimetres in length. As the fibres were incorporated into the stirred mixture, the composition changed from a weak gel to a firm plastic composition. 15 parts of zinc chromate were then added to the composition which was extruded into cylindrical cartridges which had been fabricated from waxed paper. The cartridges were then detonated using two No 8 aluminium detonators.

EXAMPLE 7

A dry premix was prepared by mixing 663 parts of powdered ammonium nitrate, 30 parts of sodium nitrate, 100 parts of "Aluminium powder 125", and 6 parts of a xanthan gum available under the designation "Biopolymer" XB23. To this premix there was added 50 parts of sugar dissolved in 110 parts of water. The resultant mixture was stirred to a uniform mass during which time the gum became hydrated. A slurry of 40 parts of water, 0.8 part of potassium antimony tartrate, 2.5 parts of asbestos fibres and 5 parts of chopped zirconia fibres was then added to and mixed with the mixture prepared above and then 0.8 part of ceric sulphate was added. There was thus obtained a detonable, strongly gelled explosive composition.

EXAMPLE 8

606 parts of powdered ammonium nitrate, 100 parts of sodium nitrate, 30 parts of calcium nitrate, 20 parts of "Aluminium powder 125" and 4 parts of guar gum were blended to form a mixture and to this mixture there was added with stirring a solution made by dissolving 50 parts of sugar in 130 parts of water and in which there was dispersed 20 parts of gilsonite and 20 parts of sulphur. Stirring was continued until the guar gum became hydrated and there was then added to the stirred mixture 3 parts of nylon 66 fibre and 20 parts of "Aluminium powder No 408". The resultant slurry explosive was transferred to cylindrical cardboard tubes. They were stored for four weeks at a temperature of 24° C and were detonable using 140 grams of pentolite.

EXAMPLE 9

Using a mixer of the Schrader type having a capacity of 9 kilograms a mixture was prepared by mixing 490 parts of prilled ammonium nitrate, 25 parts of powdered sodium nitrate, 75 parts of sugar, 350 parts of water and 10 parts of guar gum. To this mixture was added 50 parts of retiporous granules derived from melamine-formaldehyde resin wherein the formaldehyde/melamine molar ratio was 4/1. Such granules act as agents to sensitize explosive compositions to detonation and their preparation is discussed in Example 12 of British Patent Specification No. 1,314,285. To this explosive composition there was added a fibrous mixture containing 3 parts of nylon 6 fibre in which the majority of the fibres were about 5 millimeters in length and 1 part of fibrous kapok. The fibres were stirred into the mixture during which time the mixture was converted from a pourable form to one which was viscous and putty-like. The composition so formed was extruded into cardboard cylinders having a diameter of 12.5 centimeters and the cartridges so formed were detonated using 300 grams of pentolite.

EXAMPLE 10

A dispersion was prepared wherein 4 parts of guar gum were hydrated in a mixture of 600 parts of ammonium nitrate, 130 parts of sodium nitrate, 136 parts of water, 50 parts of sugar, 30 parts of sulphur, 70 parts of aluminium, 20 parts of gilsonite and 0.3 part of arsenious oxide. A fibrous slurry was prepared by dispersing 3 parts of the nylon 66 fibres used in Example 2 in a solution which had been prepared by dissolving 1 part of sodium dichromate in 9 parts of water. Using the apparatus described in Examples 1 and 3 of Belgian Patent Specification No. 778210 and the method of Example 4 of the same patent the dispersion was pumped at a rate of 32 kilograms per minute through a loading hose to an attached interfacial surface generator mixer. The fibrous slurry was pumped at a rate of 150 milliliters per minute and injected into the dispersion just before the latter passed out of the loading hose and through the interfacial surface generator mixer. The explosive composition so formed was thus located in a borehole in the form of a stiff cohesive gel which was detonated successfully four hours later.

EXAMPLE 11

For the purposes of comparison a mixture was prepared from 3000 parts of ammonium nitrate, 360 parts of thiourea, 5184 parts of water and 216 parts of the copolymer used in Example 1 and there was then added with stirring 180 parts of a solution containing equal weights of water and sodium dichromate. The mixture so prepared was placed in polyethylene cylinders which had a diameter of 5 centimeters and a length of 5.5 centimeters, and after 16 hours it was observed that the mixture had been converted to a gel. The samples of the gel so obtained, which was a precursor of a slurry explosive composition, were removed from the cylinders and were tested to destruction using the well known testing device available under the registered trade mark of "Instron" and which is used to determine the compression at the break point of materials. It was found that the samples could be compressed by no more than 1.0 centimeters before they broke.

EXAMPLES 12 TO 17 INCLUSIVE

The general procedure of Example 11 was repeated except that in each of Examples 12 to 17 there was added to the mixture immediately prior to the addition of the sodium dichromate solution 150 parts of synthetic fibrous yarns as set out in Table 2. Table 2 also contains data relating to the yarn thicknss and length, and the extent to which the gels could be compressed prior to break. The products of these examples were more robust than was the product of comparative Example 11.

TABLE 2

| Example No | Fibrous yarn Polymer | Length (millimeters) | Thickness (microns) | Compression (centimeters) |
|---|---|---|---|---|
| 12 | Polyester | 20 | 23 | 1.8 |
| 13 | Nylon | 20 | 60 | 1.2 |
| 14 | Nylon | 20 | 100 | 1.5 |
| 15 | Nylon | 3-6 | 40 (bulked) | 1.8 |
| 16* | Polyester/ Nylon | 20 | 23 | 1.2 |
| 17 | Polyester | 3-6 | 13 | 1.1 |

*Trilobal shaped fibres containing equal weights of nylon and polyester.

EXAMPLES 18 TO 35 INCLUSIVE

In these examples a range of explosives compositions was prepared by the admixture of differing fibrous materials in various amounts to a composition described in Example 1. The type, average length and average diameter of the fibrous materials, together with the percentage which they constitute of the explosive composition is set out in Table 3. In Table 3 also there is set down quantitative measurements of two stress values which are related to the rigidity of the explosive composition; the greater the stress value the more rigid is the composition. The stress values are related to the magnitude of the forces required to deform a cylindrical sample of an explosive composition either (a) along the longitudinal axis of the cylinder (axial stress) or (b) at right angles to this longitudinal axis (lateral stress). The stress values, which are referred to as axial and lateral stress gradients and defined hereinbelow, are expressed as grams weight per cubic centimeter at a temperature of 19° C. The stress values were determined by the following procedure: The "Instron" testing device referred to in Example 11 was modified so that a cylindrical brass probe was secured to a crosshead which was set to move downwards at a constant rate of 1 centimeter per minute. To determine the axial stress value a three day-old sample of the explosive composition was confined in a cylindrical plastic vial of diameter 2.4 centimeters which fitted snugly into a cylindrical hole in a jacketed sample holder maintained at a temperature of 19° C by means of water circulated from a thermostated waterbath. The brass probe was lowered so that it passed longitudinally through the sample, and the resistance of movement of the probe through the sample as a function of the depth of penetration was detected by conventional transducer means and recorded on conventional recording chart paper. The stress value, referred to hereinbefore, is defined as the maximum value of the gradient of a curve derived from values of the expression, $$\frac{\text{Resistance to penetration per unit area of probe cross-section}}{\text{Depth of penetration}}.$$

The lateral stress value was obtained in a similar manner except that the explosive composition in the form of a cylinder of diameter of 2.5 centimeters was placed in a groove in the sample holder and the probe was passed transversely through the sample. In Table 3 the fibrous material referred to as "Spindrift" (Registered Trade Mark) is a random polyester material containing a range of lengths and diameters of loose and clumped fibres; and "Perlon" is a registered trade mark for material believed to comprise polycaprolactam. The reference to "flock" materials is related to fibrous materials available commercially in short, cut lengths and suitable for use as a raw material in conventional electrostatic flocking processes.

EXAMPLE 36

This is a comparative example wherein the composition of Example 1 was tested by the procedures used in Examples 18 to 35 inclusive to determine the axial stress and lateral stress values thereof. These are set out in Table 3 and it will be observed that the values of this example are less than the corresponding values of Examples 18 to 35 inclusive.

EXAMPLES 37 TO 41 INCLUSIVE

The general procedure of Examples 31 to 35 was repeated except that the axial and lateral stress values were determined at a temperature of 38° C. The results obtained are set out in Table 4.

EXAMPLE 42

The general procedure of Example 36 was repeated except the axial and lateral stress values were determined at a temperature of 38° C. The results obtained are set out in Table 4 and it will be observed that the values of this comparative example are less than the corresponding values of Examples 37 to 41 inclusive.

TABLE 3

| Ex. No | Fibrous material Type | Length mm | Diameter micron | Concentration % | Axial stress gradient at 19° C g/cm³ | Lateral stress gradient at 19° C g/cm³ |
|---|---|---|---|---|---|---|
| 18 | Drawn nylon | 4.8 | 24 | 0.8 | 2700 | 950 |
| 19 | " | 6.4 | 24 | 0.8 | 2900 | 1300 |
| 20 | " | 19.1 | 24 | 0.8 | 5000 | 3500 |
| 21 | " | 6.4 | 24 | 0.2 | 2100 | 1200 |
| 22 | " | 19.1 | 24 | 0.2 | 3200 | 2100 |
| 23 | " | 6.4 | 20 | 0.5 | 2500 | 2000 |
| 24 | " | 6.4 | 100 | 0.5 | 1900 | 1700 |
| 25 | " | 12.7 | 24 | 0.8 | 4400 | 3700 |
| 26 | " | 12.7 | 100 | 0.8 | 1600 | 1700 |
| 27 | Random polyester "Spindrift" | 0.5 | 15 | 1.6 | 1600 | 1100 |
| 28 | Nylon flock | 10 | 66 | 0.2 | 2000 | 1200 |
| 29 | " | 0.5 | 15 | 0.8 | 2100 | 1000 |
| 30 | "Perlon"flock | 5 | 51 | 0.8 | 1500 | 1100 |
| 31 | Drawn nylon | 6.4 | 60 | 0.5 | 2300 | 1700 |
| 32 | Rayon flock | 4 | 45 | 0.8 | 2400 | 1900 |
| 33 | Raw nylon flock | 2 | 21 | 0.8 | 2000 | 1100 |
| 34 | Drawn polyester | 6.4 | 24 | 0.8 | 2700 | 1900 |
| 35 | Glass | 6.4 | 15 | 0.8 | 1800 | 900 |
| 36 | Nil (Comparative) | — | — | — | 1100 | 700 |

TABLE 4

| Example No | Composition of Example No | Axial stress gradient at 38° C g/cm³ | Lateral stress gradient at 38° C g/cm³ |
|---|---|---|---|
| 37 | 31 | 660 | 400 |
| 38 | 32 | 650 | 350 |
| 39 | 33 | 800 | 300 |
| 40 | 34 | 1200 | 550 |
| 41 | 35 | 860 | 280 |
| 42 | 36 (Comparative) | 450 | 200 |

EXAMPLE 43

3490 parts of crushed ammonium nitrate, 1870 parts of urea and 640 parts of sodium nitrate were placed in a container fitted with stirring means and heating means, and the components were stirred and heated to a temperature of 70° C at which temperature the components were in the form of a melt. To this melt there was added with stirring 20 parts of starch, 40 parts of ethylene glycol, 55 parts of fuel oil, 20 parts of thiourea and 10 parts of a 50% aqueous solution of sodium nitrite to form a mixture. To the mixture so formed there added with stirring 3860 parts of prilled ammonium nitrate to form a detonable explosive composition which was pumpable at ambient temperatures. To this explosive composition there as incorporated 100 parts of flocked polyester fibres which were 3 millimeters long. It was observed after the fibres had been added to the composition that the viscosity of the composition increased.

I claim:

1. A slurry explosive composition which comprises at least one inorganic oxidizing salt, a liquid solvent disperser or carrier for said salt, fuel material, and 0.001% to 3% by weight of a rheology modifying agent in the form of fibrous material the fibres of which are thread-like bodies or filaments that at least in part comprise or can be derived from material selected from the group consisting of animal tissue, vegetable tissue, resinous material, polymeric material and minerals, and the ratio of the longitudinal dimension to the transverse dimension of said fibres being at least 10:1.

2. A composition according to claim 1 wherein the said fibrous material is derived from material in which the ratio of the longitudinal dimension to the transverse dimension is in a range from 10:1 to 1000:1.

3. A composition according to claim 1 wherein the said fibrous material has a length in a range from 0.5 to 30 millimeters.

4. A composition according to claim 1 wherein the said fibrous material is derived from a polymer selected from the group consisting of polyamides, polyesters, polyolefines, polyurethanes and polyacrylonitriles.

5. A composition according to claim 4 wherein the said fibrous material is selected from the group consisting of nylon 6, nylon 66, poly(ethylene terephthalate), poly(ethylene) and poly(acrylonitrile).

6. A composition according to claim 1 wherein the said fibrous material is derived from material selected from the group consisting of asbestos, glass and refractory oxides.

7. A composition according to claim 6 wherein the said refractory oxide is selected from the group consisting of alumina and zirconia.

8. A composition according to claim 1 wherein the said fibrous material is derived from cellulose.

9. A composition according to claim 1 wherein the said fibrous material constitutes from 0.001 to 2% w/w of the said composition.

10. A composition according to claim 1 wherein the said fibrous material constitutes from 0.1 to 0.6% w/w of the said composition.

11. A composition according to claim 1 wherein the said salt is selected from the group consisting of the perchlorates and nitrates of the alkali metals, the alkaline earth metals and ammonium and constitutes from 30 to 90% w/w of the said composition; the said liquid solvent, disperser or carrier constitutes from 3 to 60% w/w of the said composition; the said fuel material is selected from organic water soluble substances which constitute from 0.5 to 10% w/w of the said composition, water insoluble and sparingly water soluble materials which constitute from 1 to 10% w/w of the said composition, and metallic water insoluble materials which constitute up to 25% w/w of the said composition; and the said thickening agent is selected from the group consisting of galactomannan gums, xanthan gums and polymeric materials derived from acrylamide and constitutes from 0.1 to 3% w/w of the said composition.

12. A composition according to claim 11 wherein the said salt is selected from the group consisting of sodium nitrate, calcium nitrate and ammonium nitrate and constitutes from 60 to 85% w/w of the said composition; the said liquid solvent is water and constitutes from 3 to 25% of the said composition; the said fuel material is selected from organic water soluble substances which constitute from 4 to 7% w/w of the said composition, water insoluble and sparingly water soluble materials which constituted constitute 4 to 7% w/w of the said composition, and metallic powders which constitute from 0.5 to 20% w/w of the said composition; and the said thickening agent is selected from the group consisting of guar gum, hydroxypropylguar gum, locust bean gum, biopolymeric material derived from *Xanthomonas campestris* and copolymeric material containing a major proportion of polyacrylamide and constitutes from 0.3 to 1.5% w/w of the said composition.

13. A process for the manufacture of a slurry explosive composition which process comprises forming an explosive mixture comprising at least one inorganic oxidizing salt, a liquid solvent disperser or carrier for said salt, fuel material, and to said mixture adding 0.001% to 3% w/w of the said composition of material which is formed of fibres the said fibres having a ratio of longitudinal dimension to transverse dimension of at least 10:1 and being thread-like bodies or filaments that at least in part comprise or can be derived from material selected from the group consisting of animal tissue, vegetable tissue, resinous material, polymeric material and minerals and incorporating said fibrous material into said composition in a manner such that the rheological properties of the said composition are modified.

14. A composition as in claim 1 containing at least one thickening agent.

15. A composition as in claim 14 wherein said thickening agent is a crosslinked thickening agent.

* * * * *